US006381975B1

(12) United States Patent
Tsuchikawa

(10) Patent No.: US 6,381,975 B1
(45) Date of Patent: May 7, 2002

(54) ICE DISPENSER

(75) Inventor: Koji Tsuchikawa, Aichi-ken (JP)

(73) Assignee: Hoshizaki Denki Kabushiki Kaisha, Toyoake (JP)

( * ) Notice: Subject to any disclaimer, the term of this patent is extended or adjusted under 35 U.S.C. 154(b) by 0 days.

(21) Appl. No.: 09/851,333

(22) Filed: May 9, 2001

(51) Int. Cl.[7] ..... F25C 1/00
(52) U.S. Cl. ..... 62/233; 62/354
(58) Field of Search ..... 62/233, 354

(56) References Cited

U.S. PATENT DOCUMENTS

| | | | | | |
|---|---|---|---|---|---|
| 32,360 | A | * | 5/1861 | Martineau | 280/11.14 |
| 4,227,377 | A | * | 10/1980 | Miller | 222/56 |
| 4,771,609 | A | * | 9/1988 | Funabashi | 62/137 |
| 4,787,539 | A | * | 11/1988 | Uchida et al. | 222/639 |
| 4,817,827 | A | * | 4/1989 | Kito et al. | 222/238 |
| 4,846,381 | A | * | 7/1989 | Kito et al. | 222/236 |
| 6,009,718 | A | * | 1/2000 | Ikari et al. | 62/354 |

* cited by examiner

*Primary Examiner*—Harry B. Tanner
*Assistant Examiner*—Mohammad M Ali
(74) *Attorney, Agent, or Firm*—Wenderoth, Lind & Ponack, L.L.P.

(57) ABSTRACT

Disclosed is an ice dispenser in which an agitating device (11) is operated only when necessary to thereby prevent ice cubes in an ice storage vessel (18) from sticking together, allowing ice to be smoothly discharged from the ice storage vessel (18). The ice dispenser includes an ice-making device (1), the ice storage vessel (18), an ice discharge port (41), an agitating device (11) for agitating the ice in the ice storage vessel (18), and an operation control device (30) which operates the agitating device (11) at the time of ice discharge or ice-making operation and which causes, when no ice-making operation is being performed, the agitating device (11) to operate after an interval of a predetermined first set time for a predetermined second set time by timer means (TM 1, TM 2), wherein when the agitating device (11) is stopped by stopping the ice discharge or ice-making operation, the operation control device (30) resets the timer means (TM 1) to start the first set time.

6 Claims, 5 Drawing Sheets

ICE DISPENSER

BACKGROUND OF THE INVENTION

1. Field of the Invention

The present invention relates to an ice dispenser and, in particular, to the operation control of an agitating device in an ice storage vessel of an ice dispenser.

2. Background of the Related Art

In conventional ice dispensers, it can happen that ice cubes in the ice storage vessel are melted and stick together in clusters, thereby hindering the discharge of ice cubes or deteriorating the ice quality. Thus, in such ice dispensers, an agitating device is provided in the ice storage vessel in order to prevent ice cubes from sticking together in clusters, and this agitating device is periodically operated. An example of an ice storage vessel provided with such an agitating device is disclosed in Japanese Examined Utility Model Publication No. 61-27033.

According to the above-mentioned publication, when the ice storage vessel is filled to capacity, the ice-making operation is stopped, and, at the same time, a timer starts set-time counting. Each time the timer expires, i.e., each time the set time expires, a scrape-out fin (agitating device) is rotated. In ice dispensers of this type, the scrape-out fin is usually also rotated when discharging ice.

However, in the scrape-out fin control according to the prior-art technique described in Japanese Utility Model Publication No. 61-27033, the timer is not reset when the scrape-out fin is operated for the purpose of discharging ice. Thus, it can happen that immediately after ice is discharged during the non-ice-making period to operate the scrape-out fin, the timer expires to cause further (continuous) operation of the fin. When the scrape-out fin is thus operated at an excessively short interval, the ice cubes are melted due to the friction heat of the scrape-out fin, with the result that sticking together of ice cubes is liable to occur. Thus, ice cubes are not sufficiently prevented from sticking together.

SUMMARY OF THE INVENTION

The present invention has been made in view of the above problem in the prior-art technique. It is accordingly an object of the present invention to provide an ice dispenser in which the agitating device in the ice storage vessel is operated to a requisite minimal degree to thereby prevent ice cubes in the ice storage vessel from sticking together and allow ice to be smoothly discharged from the ice storage vessel and in which it is possible to maintain a fixed quality of ice discharged.

To achieve the above object, in a main aspect of the present invention, there is provided an ice dispenser comprising an ice-making device, an ice storage vessel, an ice discharge port, an agitating device for agitating ice in the ice storage vessel, and an operation control device which operates the agitating device at the time of ice discharge and ice-making operation and which, when no ice-making operation is being performed, causes the agitating device to operate after an interval of a predetermined first set time for a predetermined second set time by timer means, wherein, when the agitating device is stopped by stopping the ice discharge or ice-making operation, the operation control device resets the timer means to start the first set time.

In this ice dispenser, constructed as described above, when ice discharge or ice-making operation is performed to operate the agitating device, the first set time is started upon stopping the operation of the agitating device, so that there is no possibility of the agitating device being re-operated immediately after the operation of the agitating device at the time of ice discharge or ice-making operation. For this purpose, the agitating device is operated after an interval of a predetermined first set time, thereby eliminating the possibility of unnecessary operation of the agitating device. Thus, it is possible to some degree to prevent ice cubes from sticking together. This also enables the ice in the ice storage vessel to be smoothly discharged.

In another aspect of the present invention, there is provided an operation control device for use in the above-described ice dispenser.

In still another aspect of the present invention, there is provided an ice dispenser operation control method comprising the steps of: preparing an ice dispenser as described above, and resetting the timer means to start the first set time when the agitating device is stopped by stopping ice discharge or ice-making operation.

DESCRIPTION OF THE PREFERRED EMBODIMENTS

Figure 1:
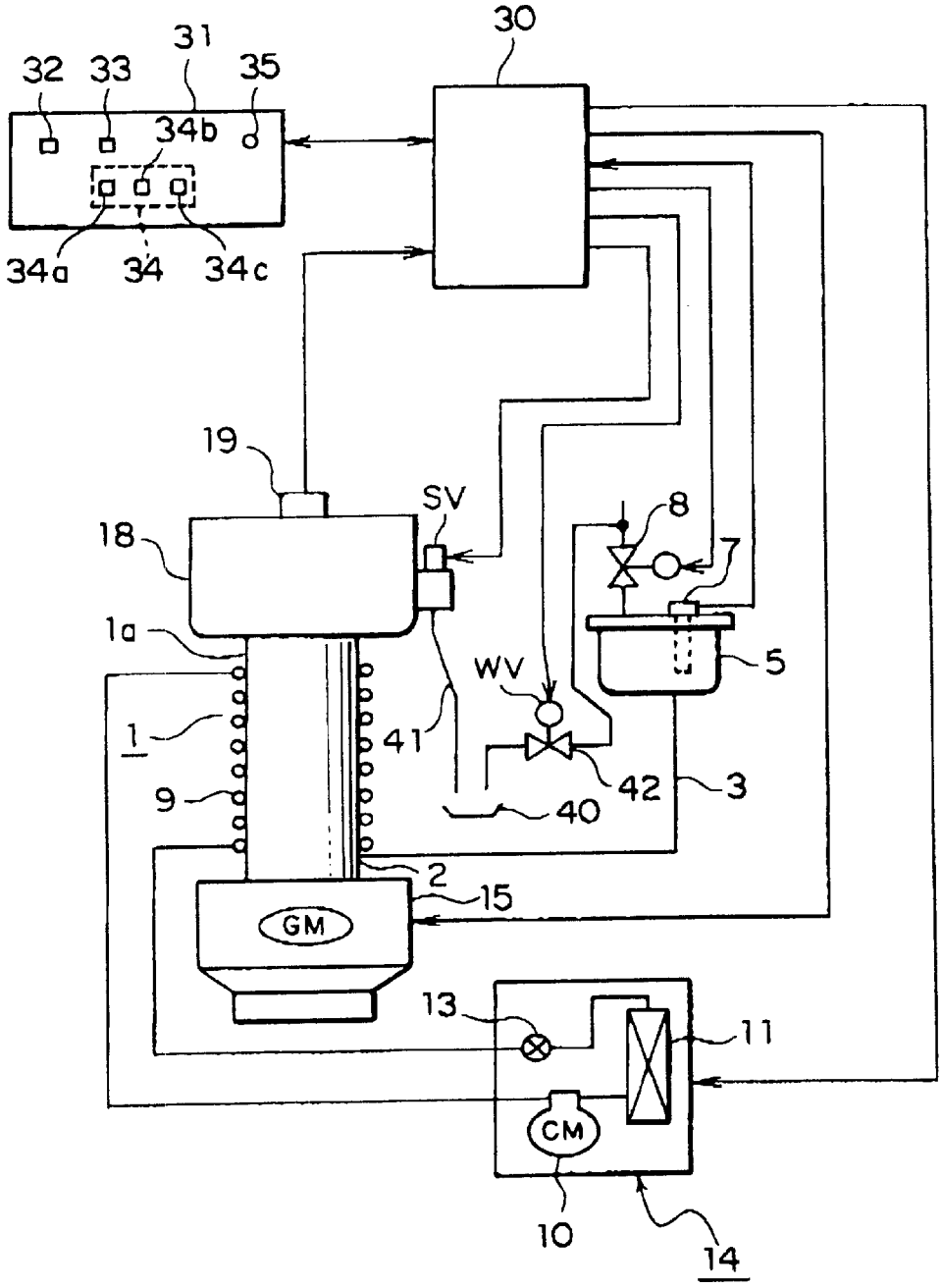
FIG. 1 is a schematic diagram showing the general construction of an auger-type ice machine according to an embodiment of the present invention.

Embodiments of the present invention will now be described in detail with reference to FIGS. 1 through 5. In FIGS. 1 through 5, the present invention is applied to an auger-type ice machine. FIG. 1 schematically shows the general construction of the auger-type ice machine, and FIG. 2 specifically shows the construction of the portion of this auger-type ice machine around the ice-making device thereof.

As shown in FIG. 1, the auger-type ice machine comprises an ice-making device 1 mainly consisting of an ice-making cylinder 1*a,* an ice storage vessel 18 provided at the top of the ice-making device 1, an ice-making water tank 5 provided by the side of the ice-making device 1, a refrigerator 14 for cooling the ice-making cylinder 1*a,* an operating panel 31, and a controller 30.

Figure 2:
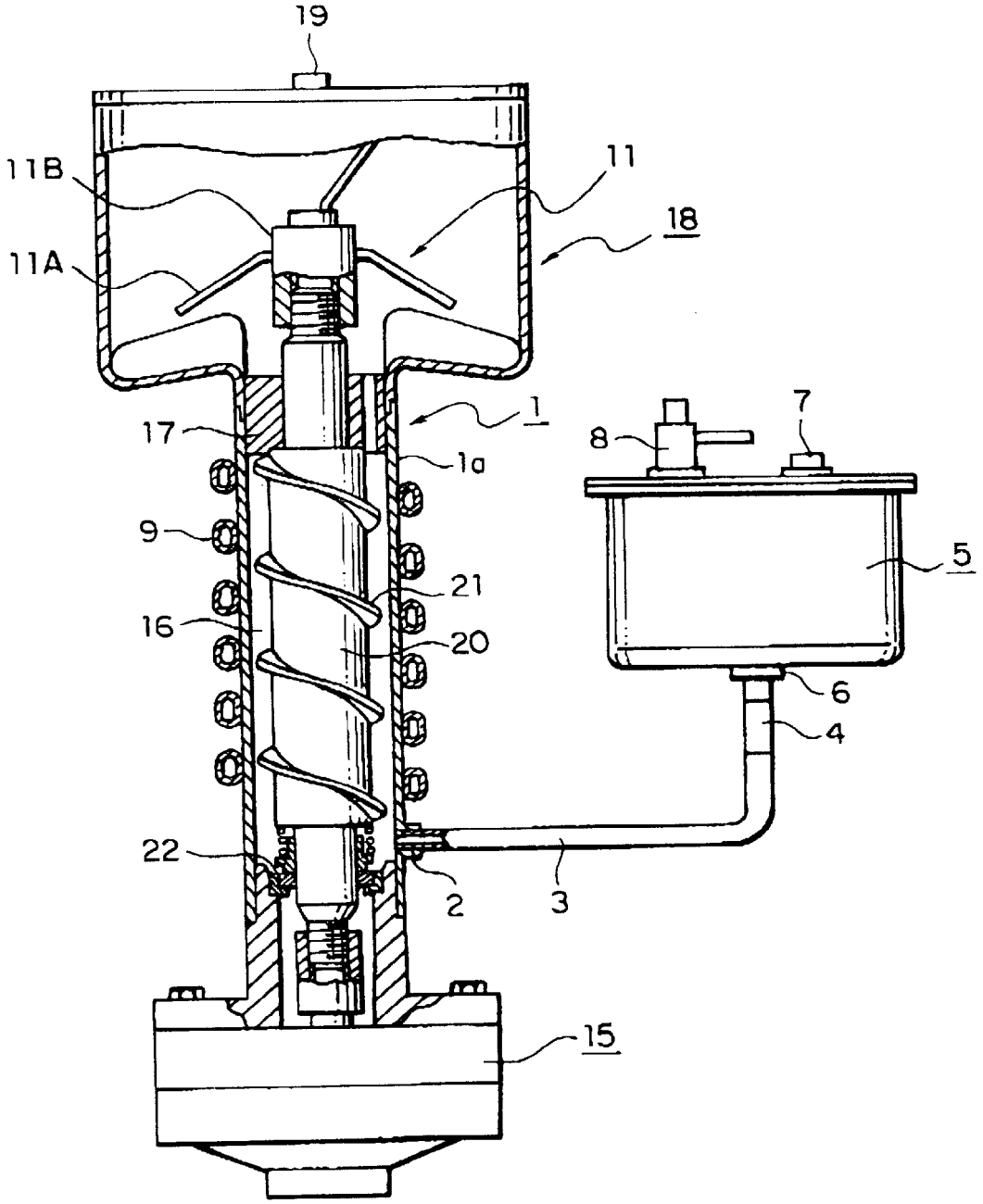
FIG. 2 is a diagram showing the construction of the portion of the auger-type ice machine of FIG. 1 around the ice-making device.

The ice-making cylinder 1*a* is vertically installed in the ice-machine main body and is formed of stainless steel or the like. As shown in FIG. 2, a water supply port 2 is provided in the lower portion of the ice-making cylinder 1*a,* and one end of a water supply pipe 3 is connected to this water supply port 2. The other end of the water supply pipe 3 is connected to a water Supply port 6 at the bottom of the ice-making water tank 5 through the intermediation of a connection hose 4. Thus, the ice-making water stored in the ice-making water tank 5 is supplied to the ice-making cylinder 1*a* via the connection hose 4 and the water supply pipe 3.

An auger 16 is provided in the ice-making cylinder 1*a*. The auger has a rotating shaft portion 20 and a spiral blade provided in the periphery of the rotating shaft. The lower end portion of the auger 16 is connected to a geared motor (GM) 15, which is a driving device. A mechanical seal 22 is arranged at the lower end of the rotating shaft portion 20 to hermetically seal the lower end portion of the ice-making cylinder 1*a*.

Spirally wound around the outer peripheral surface of the ice-making cylinder 1*a* is an evaporator 9 in the form of a cooling tube. The evaporator 9 serves to cool the ice-making cylinder 1*a,* and constitutes a part of the refrigerator 14. That is, as shown in FIG. 1, the refrigerator 14 consists of a refrigerant circuit in which a compressor (CM) 10, a condenser 11, an expansion valve 13, the evaporator 9, etc. are sequentially connected.

The ice-making water tank 5 is provided with a float switch 7. The float switch 7 senses the upper-limit water level and the lower-limit water level in the ice-making water tank 5. When the float switch 7 senses the lower-limit water level in the ice-making water tank 5 by the control of a controller 30, a water supply valve 8 provided in the water supply circuit opens, and ice-making water is supplied to the ice-making water tank 5. When the float switch 7 senses the upper-limit water level in the ice-making water tank 5, the water supply valve 8 is closed, and the water supply to the ice-making water tank 5 is stopped.

An ice storage vessel 18 stores ice supplied from the ice-making cylinder 1*a*. More specifically, when ice-making water is supplied from the ice-making water tank 5 to the the ice-making operation of this auger-type ice machine is started. The ice-making water in the ice-making cylinder 1*a* is cooled by the cooling effect of the refrigerator 14, with the result that thin ice is formed on the inner wall surface of the ice-making cylinder 1*a*. And, the thin ice formed on the inner wall surface is scraped off by the auger 16 rotated by the geared motor (GM) 15. Then, the thin ice scraped off is transferred to a pressure head 17 provided in the upper portion of the ice-making cylinder 1*a,* and is compressed and solidified by this pressure head 17. Thereafter, the solidified ice is cut into pieces by a cutter (not shown), and the ice cut into pieces is transmitted to the ice storage vessel 18, provided at the upper end of the ice-making cylinder 1*a,* and stored there.

The ice storage vessel is provided with a conventional ice storage switch 19. An upper set value and a lower set value are set for the ice storage switch 19. The upper set value is set to a full ice amount value corresponding to the state in which the ice storage vessel 18 is substantially filled to capacity, and the lower set value is set to a value corresponding to a state in which the ice storage amount in the ice storage vessel 18 has been reduced by a fixed amount from the upper set value (full ice amount value). And, when it detects that the ice storage amount in the ice storage vessel 18 has reached the upper set value (full ice amount value), the ice storage switch 19 outputs an ON signal to the controller 30. When it detects that the ice storage amount in the ice storage vessel 18 has been reduced to reach the lower set value, the ice storage switch 19 outputs an OFF signal to the controller 30.

Further, the ice storage vessel 18 is provided with a discharge port for discharging ice. The discharge port is provided with an electromagnetic opening/closing gate SV (See FIG. 1), and an ice discharge passage 41 extends to a position above a pan 40. Further, to enable the user to be supplied with water, a water supply tube 42 connected in parallel with the water supply valve 8 extends to a position above the pan 40. At some midpoint in the water supply tube 42, there is provided a water valve WV serving as an opening/closing valve Further, an agitating device 11 is arranged inside the ice storage vessel 18. The agitating device 11 is composed of a rotation shaft 11B and agitating bars 11A radially extending from the rotation shaft 11B. The rotation shaft 11B is connected to the upper end portion of the rotating shaft portion 20 of the auger 16. Thus, the agitating device 11 is rotated integrally with the auger 16 by being driven by the geared motor (GM) 15.

The operation of this auger ice machine, constructed as described above, is controlled by the controller 30 in accordance with an operation command from the operating panel 31. The operating panel 31 is provided with an ice-making switch 32, a discharge switch 33, and a selection key 34 for selecting between water and ice. The selection key 34 is provided with keys 34*a,* 34*b,* and 34*c* allowing selection of three discharge modes: "water only", "ice only", and "water and ice".

The controller 30 is composed of a microcomputer, memory, etc. An ON/OFF signal of the ice-making switch 32 and an ON/OFF signal of the discharge switch 33 are input to the controller 30 from the operating panel 31, and further, ON/OFF signals of the ice storage switch 19, the float switch 7, etc. are input thereto. And, this controller 30 forms an operation control device which performs control as described below.

[Control by Operation Control Device]

Figure 3:
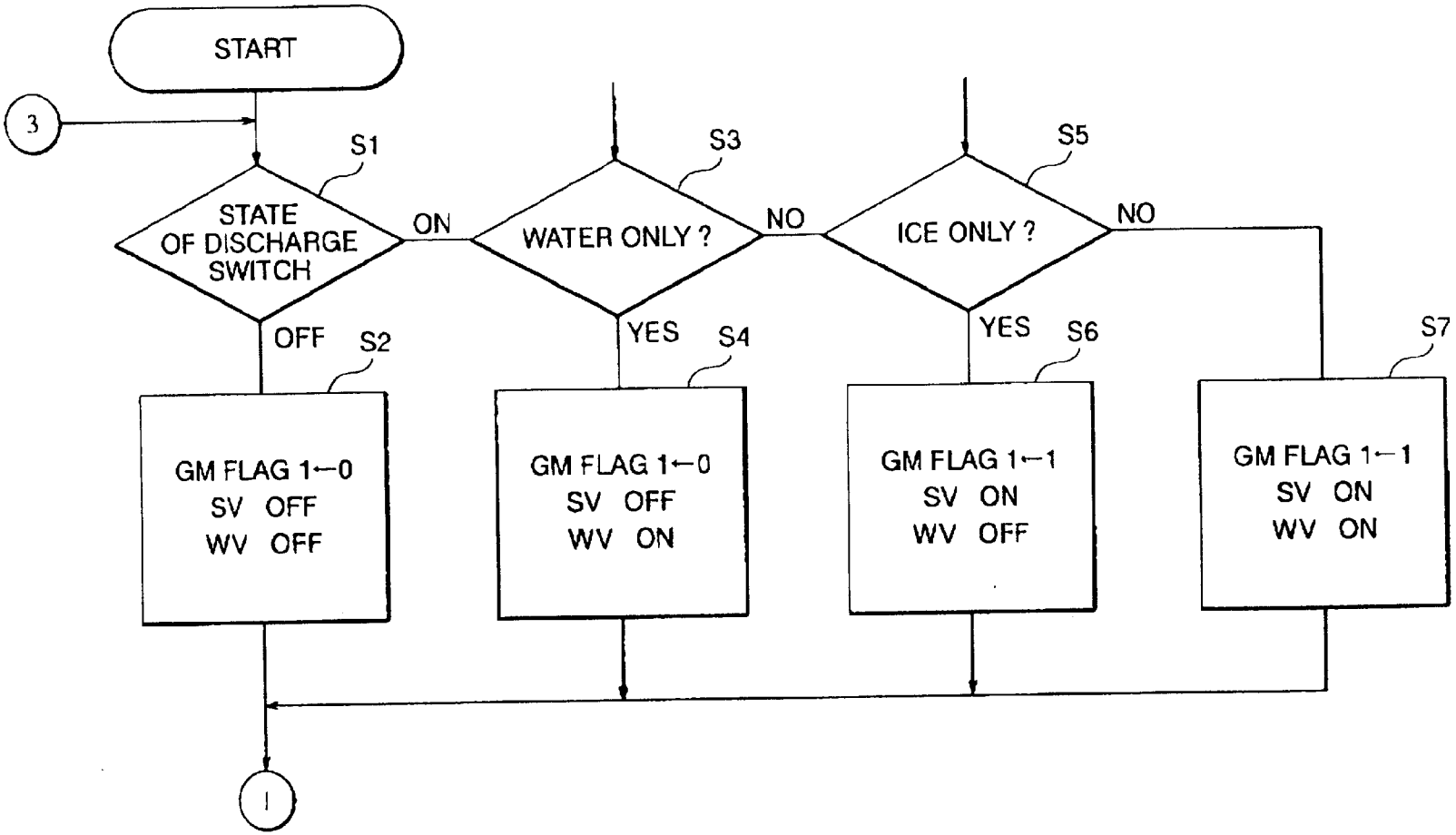
FIG. 3 is a discharge-mode flowchart for an operation control device of the auger-type ice machine of FIG. 1.

FIG. 3 is a flowchart illustrating the discharge mode of the operation control device. First, the condition of the discharge switch 33 is checked (Step S1) . When the discharge switch 33 is OFF, there is no operation command for ice discharge, and ice is not discharged. In this case, the electromagnetic opening/closing gate SV is closed (SV off), and the water valve WV is closed (WV off). Further, a GM flag 1 is set to 0 (Step S2). When the discharge switch 33 is ON (i.e., when the switch state in Step S1 is ON), it is checked which of the selection keys 34*a,* 34*b,* and 34*c* for "water only", "ice only", and "water and ice" of the selection key 34 is selected (Steps S3 and S5).

When the selection key 34*a* for "water only" is ON (when the answer in Step S3 is YES), the electromagnetic opening/closing gate is closed (SV off), and the water valve WV is opened (WV on) to discharge water only, and the GM flag 1 is set to 0 (Step S4). When the "ice only" mode is selected (when the answer in step S3 is NO, and the answer in Step S5 is YES), the electromagnetic opening/closing gate SV is opened (SV on), and the water valve WV is closed (WV off) to discharge ice only, and the GM flag 1 is set to 1 (Step S6). When the "water and ice" mode is selected (when the answer in Step S5 is NO), the electromagnetic opening/closing gate SV is opened (SV on), and the water valve WV is opened (WV on) to discharge ice and water. Further, the GM flag 1 is set to 1 (Step 57).

Figure 4:
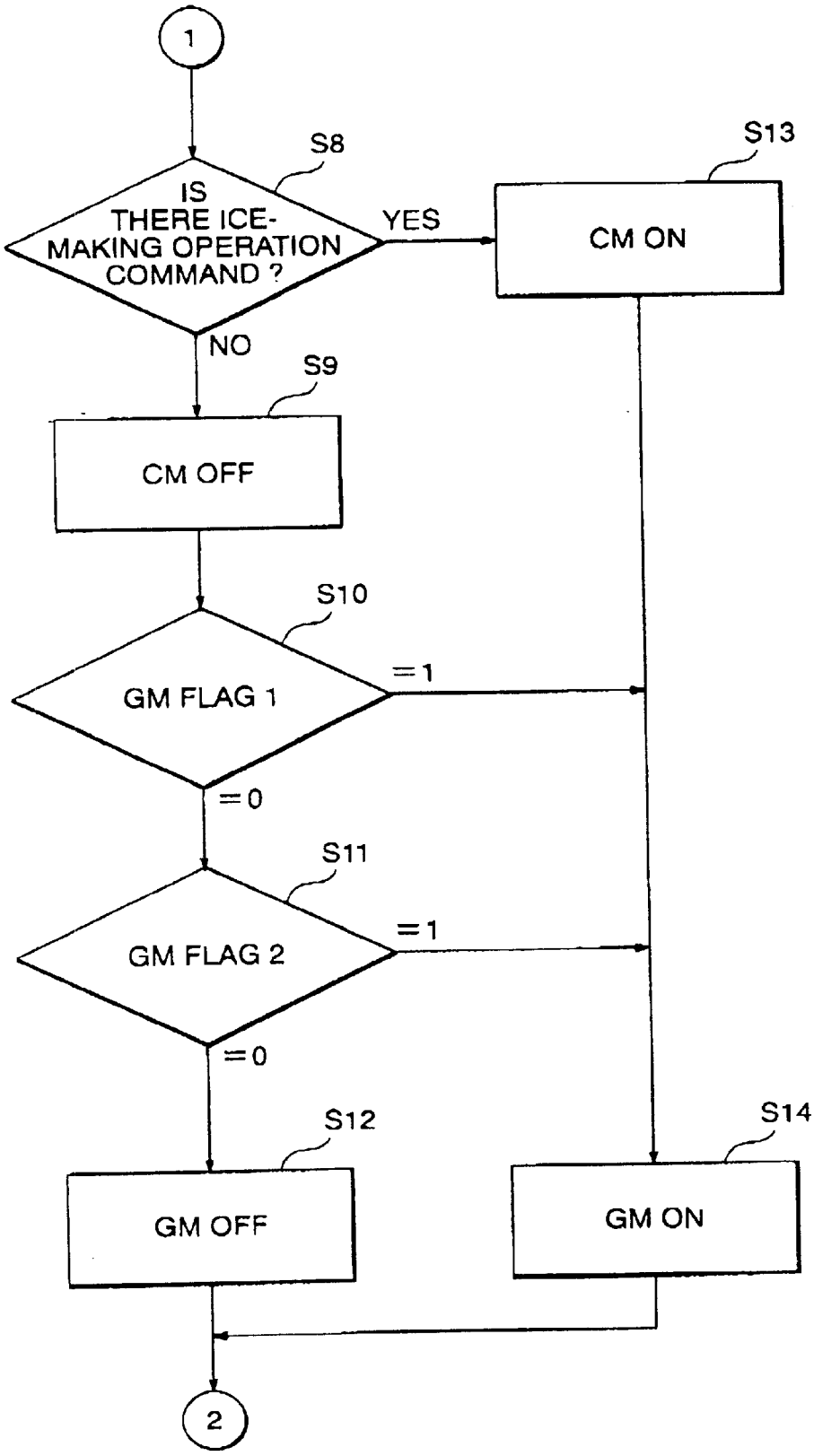
FIG. 4 is a flowchart illustrating an ice-making operation and a geared-motor operation in the operation control device of the auger-type ice machine of FIG. 1.
Figure 5:
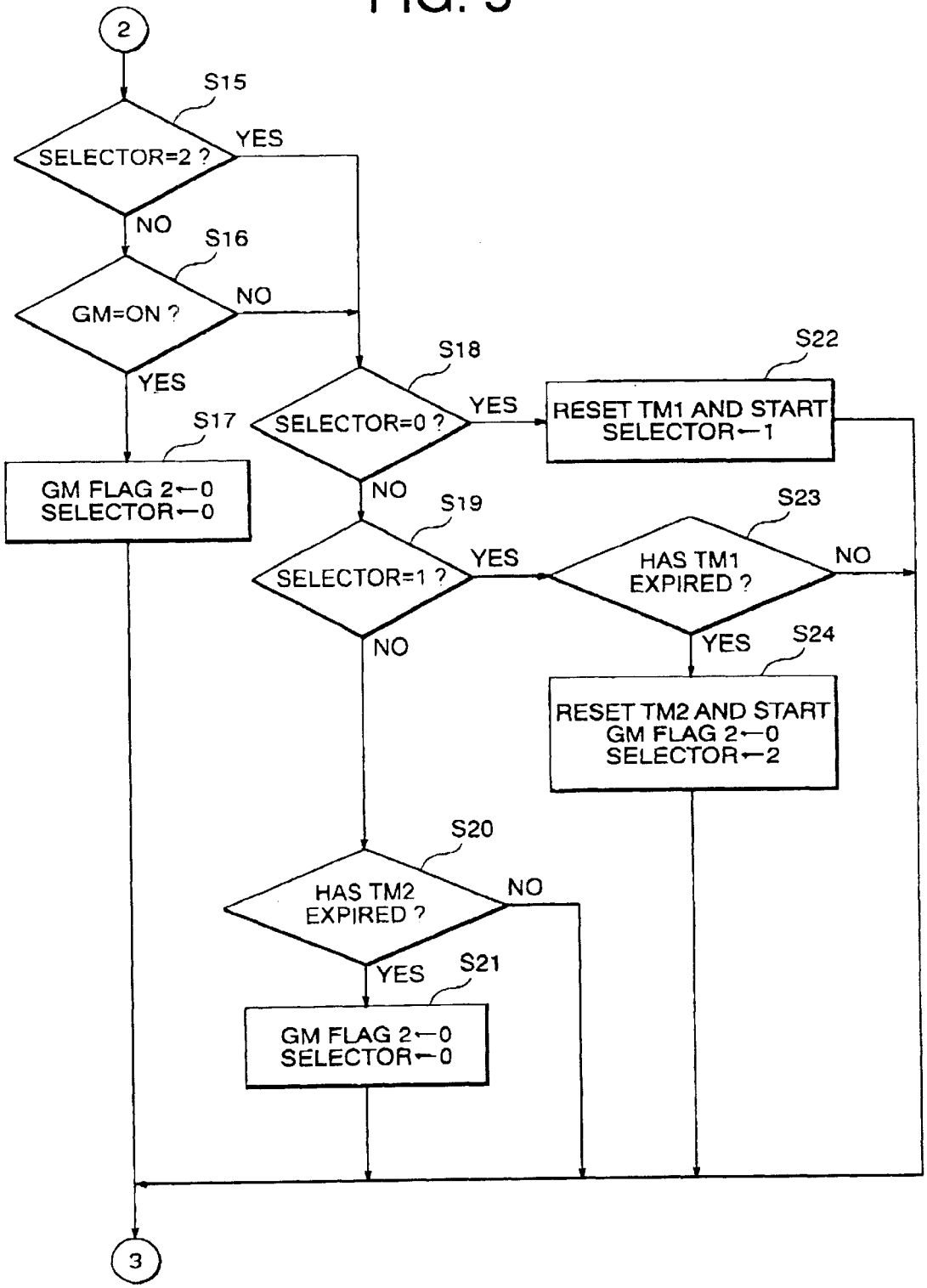
FIG. 5 is a timer control flowchart for an agitating device (geared motor) in the operation control device of the auger-type ice machine of FIG. 1.

Next, FIG. 4 is an operational flowchart illustrating the control of the ice-making operation and the operation of the geared motor (GM) 15 (agitating device 11) by the operation control device, and FIG. 5 is a flowchart illustrating the timer control of the geared motor (agitating device 11) by the operation control device.

As stated above, when the ice storage amount in the ice storage vessel 18 reaches the upper set value, the ice storage switch 19 is turned on. Thereafter, the ice storage switch 19 maintains the ON-state when the ice storage amount has not been reduced to the lower set value. While the ice storage switch 19 is ON, an ice-making operation stop command is supplied from the ice storage switch 19 to the controller 30. When the ice storage amount reaches a level not higher than the lower set value, the ice storage switch 19 is turned off, and an ice-making operation start command is supplied from the ice storage switch 19 to the controller 30.

In the operational flowchart of FIG. 4 illustrating the ice-making operation, a judgment is first made as to whether there is an ice-making operation command from the ice storage switch 19 (step S8). When the emission of an ice-making operation command is confirmed (when the answer in Step S8 is YES), the compressor (CM) 10 and the geared motor (GM) 15 are operated (CM on, GM on) (Steps S13 and S14).

When it is confirmed that no ice-making command has been emitted (when the answer in Step S8 is NO), the compressor (CM) 10 is stopped (Step S9). And, when ice is discharged through ice discharge control (in the case of Steps S6 and S7 of FIG. 3), the GM flag 1 is set to 1, and the geared motor (GM) 15 is driven (Step S10 S14). Thus, in the case of ice discharge, the geared motor (GM) is driven and the agitating device 11 is operated.

Next, when no ice is discharged through ice discharge control (in the case of steps S2 and S4 in FIG. 3), the GM flag 1 is set to 0, and a judgment is made as to whether the GM flag 2 is 0 or 1 (Step S11).

In the agitating-device timer control flowchart shown in FIG. 5 (that is, in the timer control flowchart for the geared motor (GM) 15), the GM flag 2 is reset to 0 or 1 as follows. When a first timer TM 1 starts and then expires, a second timer TM 2 starts, and the GM flag 2 is reset to 1 (Step S23 S24). When the second timer TM 2 expires, the GM flag 2 is reset to 0 (Step S20 S21).

As will be apparent from the description given below, when no ice-making operation is being performed and no ice is being discharged, the agitating device 11 is controlled such that it remains at rest for "a predetermined first set time", and that it operates for "a predetermined second set time". The first timer TM1 is a timer for monitoring the first set time, and the second timer TM 2 is a timer for monitoring the second set time. Here, the term "predetermined first set time" means the time that passes until the next operation of the agitating device, and the term "predetermined second set time" means the time during which the agitating device is operated to prevent ice cubes from sticking together.

Thus, when the first set time for the first timer TM 1 expires, the GM flag 2 is reset to 1 (Step S23 S24), so that the geared motor (GM) 15 is driven and the agitating device 11 is operated (Step S11 S14). At the same time, the second timer TM 2 starts (step 524).

When the second set time for the second timer TM 2 expires, the GM flag 2 is reset to 0 (Step S20 521), so that the geared motor (GM) 15 is stopped, and the agitating device 11 is stopped (Step S11 S12).

The basic timer control operation for the agitating device is as described above. In the following, the timer control operation for the agitating device of the present invention will be described more specifically.

[The Case in which the First Set Time for the First Timer TM 1 has not Yet Expired when no Ice-making Operation is Being Performed and no Ice is Being Discharged]

First, a case will be described in which ice-making operation is started or ice discharge is effected in the condition (hereinafter referred to as "Condition A") in which the first set time for the first timer TM 1 has not expired yet when no ice-making operation is being performed and no ice is being discharged.

In the condition prior to ice-making operation or ice discharge (Condition A), the GM flag 1 is set to 0 (Step S1 →S2), and the first set time is being counted by starting the first timer TM 1. Thus, the selector is set to 1 (Step S22). Since the second set time for the second timer TM 2 has expired, the GM flag 2 is set to 0 (Step S20 S21).

Thus, in this condition, the procedures in FIG. 4 are as follows: the answer in Step S8 is NO the CM is OFF in Step S9 the flag is set to 0 in Step S10 the GM is OFF in Step S11. Thus, the geared motor (GM) 15 is not operated, which means the agitating device 11 is at rest. Here, the procedures in FIG. 5 are as follows: the answer in Step S15 is NO the answer in Step S16 is NO the answer in Step 518 is NO the answer in Step S19 is YES the answer in Step S23 is NO. Thus, the first timer TM 1 is performing counting, that is, the expiration of the first timer TM 1 is being waited for.

When in this condition (i. e, Condition A) ice-making operation or ice discharge is started, the geared motor (GM) 15 operates (Step S8 S13 S14, or S8 S9 S10 S14), so that the agitating device 11 is operated. Then, the answer in Step S16 is changed from NO to YES. Thus, the timer expiration standby state for the first timer TM 1 in Step S23 is canceled. Further, the GM flag 2 is set to 0, and the selector is reset to 0 (Step S17).

Next, when in this condition the ice-making operation or ice discharge is stopped, the GM flag 1 is reset to 0 (Step S2), so that the compressor (CM) 10 and the geared motor (GM) 15 are stopped (step S8 S9 S10 S11 S12). At the same time, the answer in Step S16 is NO and the answer in Step S18 is YES, so that the selector is reset to 1, and the first timer TM 1 is reset, with the result that the counting of the first set time is started (Step S22).

In this way, when ice-making operation or ice discharge is effected while the first timer TM 1 is counting the first set time, the agitating device 11 is operated when the ice-making operation or ice discharge is effected. And, when the ice-making operation or ice discharge is stopped, the agitating device 11 is stopped, and the first timer TM 1 is reset, the first set time starting anew. Thus, no operation of the agitating device is performed immediately after its operation at the time of ice-making operation or ice discharge, so that there is no unnecessary reduction in the operational interval of the agitating device.

[When in Condition A a State in which Neither Ice-making Operation nor Ice Discharge is Conducted Persists for Some Time]

Next, a case will be described in which, in Condition A, a state in which neither ice-making operation nor ice discharge is conducted persists for some time.

When, in Condition A, the first timer TM 1 expires (i.e. when the answer in Step S23 is YES), the second timer TM 2 is reset, and the second set time starts. At the same time, the GM flag 2 is set to 1, and the selector is reset to 2 (Step S24). Thus, in FIG. 4, the flag is set to 1 in Step S11, and the geared motor (GM) 15 is operated (Step 14) to drive the agitating device 11. And, when the second timer TM 2 expires (i.e., when the answer in Step S20 is YES), the GM flag 2 is set to 0, and the selector is set to 0 (Step S21). Thus, in FIG. 4, the flag is set to 0 in Step S11, so that the GM is OFF, that is, the geared motor (GM) 15 is stopped (Step S12). Thus, the operation of the agitating device 11 is stopped.

When, in Condition A, the state in which neither ice-making operation nor ice discharge is effected persists in this way, the agitating device 11 is at rest while the first timer TM 1 is performing counting. And, when the first timer TM 1 expires, (i.e., when the first set time is over), the second timer TM 2 is reset and starts, and, at the same time, the agitating device 11 is operated. And, when the second timer TM 2 expires (i.e., when the second set time is over), the operation of the agitating device 11 is stopped.

When the second timer TM 2 expires as described above, the procedures in FIG. 5 are as follows: the answer in Step S15 is NO the answer in Step S16 is NO the answer in Step S18 is YES, and the first timer TM 1 is reset, and the selector is reset to 1 (Step S22). Thus, the answer in Step S18 is No, and the selector is set to 1 in Step S19, so that the expiration of the first timer TM 1 is being waited for (step S23), that is, the system is in the above Condition A. Thereafter, these operations are repeated. Thus, through the operation of the first timer TM1 and the second timer TM 2, the agitating device 11 is operated in a predetermined cycle.

[When Ice-making Operation or Ice Discharge is Effected in a State in which Neither Ice-making Operation nor Ice Discharge is Being Performed and in which the First Set Time for the First Timer TM 1 has Expired, with the Second Timer TM 2 Counting the Second Set Time]

Next, a case (hereinafter referred to as "Condition B") will be described in which ice-making operation or ice discharge is effected in a state in which neither ice-making operation nor ice discharge is being performed and with the second timer TM 2 counting the second set time where the first set time for the first timer TM 1 has expired.

In the condition prior to ice-making operation or ice discharge, the first timer TM 1 has expired, so that the selector is set to 2, and the GM flag 2 is set to 1 (Step S24). The GM flag 1 is set to 0 (Steps S2 and S4).

Thus, in this condition, the procedures in FIG. 4 are as follows; the answer in Step S8 is NO the CM is OFF in Step S9 (the operation of the compressor 10 is stopped) the flag is set to 0 in Step S10 the flag is set to 1 in Step S11 the GM is ON in Step S14, and the geared motor (GM) 15 is operating. Thus, the agitating device 11 is being driven The procedures in FIG. 5 are as follows: the answer in Step S15 is YES the answer in Step S18 is NO the answer in Step S19 is NO the answer in Step S20 is NO, and the second timer TM 2 is performing counting, that is the second set time is being counted, the expiration of the second timer TM 2 being waited for.

When, in this condition, ice-making operation is started, the answer in Step S8, FIG. 4, is YES, and the compressor (CM) 10 is driven (Step S13), and the operation of the geared motor (GM) 15 is continued (Step S14), so that the operation of the agitating device 11 is maintained.

When, instead of ice-making operation, ice discharge is started, the GM flag is set to 1 in Step S6 or S7 in FIG. 3. Thus, the procedures in FIG. 4 are as follows: the answer in Step S8 is NO the CM is OFF in Step S9 (the operation of the compressor 10 is stopped) the flag is set to 1 in Step S10, and the operation of the geared motor (GM) is continued (Step S14). Thus, the operation of the agitating device 11 is maintained.

When in this Condition B, described above, the second set time for the second timer TM 2 expires during ice-making operation or ice discharge, the GM flag 2 is set to 0, and the selector is reset to 0 during the ice-making operation or ice discharge. And, when, thereafter, the ice-making operation or ice discharge is stopped, the GM flag 1 is reset to 0 (Step 52). Thus, the ice-making operation or ice discharge is stopped, whereby the geared motor (GM) 15 is stopped (Step S8 S9 S10 S11 S12), and the operation of the agitating device 11 is stopped. At the same time, the answer in Step 15 is No→the answer in Step S16 is NO the answer in Step S18 is YES, and the first timer TM 1 is reset, and the selector is reset to 1 to start the counting of the first set time by the first timer TM1 (Step S22).

In this way, when ice-making operation or ice discharge is started during the counting of the second set time by the second timer TM 2, and the second timer TM 2 expires during the ice-operation or ice discharge, the operating of the geared motor (GM) 15 is stopped and the operation of the agitating device 11 is stopped when the ice-making operation or ice discharge is completed. At the same time, the first timer TM 1 for counting the first set time (i.e., the time that passes until the next operation of the agitating device 11) is reset and started. Thus, there is no possibility of the agitating device 11 being re-operated immediately after the stopping of the agitating device 11 by the stopping of the ice-making operation or ice discharge operation, so that there is no unnecessary reduction in the operational interval for the agitating device 11

[When in Condition B the Second Timer TM 2 Expires After the Completion of Ice-operation or Ice Discharge]

Next, a situation will be described in which when in Condition B the second timer TM 2 expires after the completion of ice-operation or ice discharge. It is to be noted that the second set time (i.e., the time that the agitating device is operated in order to prevent ice cubes from sticking together) is shorter than the ice-making operation time, so that there seems to be practically no possibility of the second timer TM2 expiring after the completion of the ice-making operation.

In this case, the second timer TM 2 is performing counting after the stopping of the ice-making operation or ice discharge, that is, the operational flow is as follows: the answer in Step S15 is YES the answer in Step S18 is NO the answer in Step S19 is NO the answer in Step S20 is NO, so that the driving of the geared motor (GM) 15 is continued during the second set time including the time for the ice-making operation or ice discharge.

Thereafter, when the second timer TM 2 expires, the GM flag 2 is set to 0, and the selector is reset to 0 (step S21). As a result, in FIG. 4, the flag is set to 0 in Step S11, so that the geared motor (GM) 15 is stopped (i.e., the GM is OFF in Step S12). Thus, the operation of the agitating device 11 is stopped. Further, the answer in Step S15 is NO the answer in Step S16 is NO the answer in Step S18 is YES, and the first timer TM 1 is reset, and the selector 1 is reset to 1, causing the first timer TM 1 to start counting anew (Step S22).

Thus, in this case, the agitating device is operated in a predetermined cycle through the operation of the first timer TM 1 and the second timer TM 2.

As described above, in this embodiment, when ice-making operation is not being conducted, the agitating device is operated after an interval of a predetermined first set time for a predetermined second set time by timer means. Further, in this case, when ice-making operation or ice discharge operation is started, the first timer TM 1 for setting the first set time is reset without fail when this operation of the agitating device is stopped, so that there is no possibility of unnecessary operation of the agitating device.

While the ice dispenser of the above embodiment of the present invention is applied to an auger-type ice machine, this should not be construed restrictively.

What is claimed is:

1. An ice dispenser comprising:

an ice-making device for producing ice by cooling ice-making water by a cooling device;

an ice storage vessel for storing the produced ice;

an agitating device for agitating the ice in the ice storage vessel; and an operation control device which operates the agitating device at the time of ice discharge or ice-making operation and which when no ice-making operation is being performed, causes the agitating device to operate after an interval of a predetermined first set time for a predetermined second set time by timer means, wherein when the agitating device is stopped by stopping the ice discharge or ice-making operation, the operation control device resets the timer means to start the first set time.

2. An ice dispenser according to claim 1, wherein the timer means comprises a first timer for counting the first set time and a second timer for counting the second set time, and wherein when the agitating device is stopped by stopping the ice discharge or ice-making operation, the operation control device resets the first timer.

3. An operation control device for an ice dispenser comprising an ice-making device, an ice storage vessel, an ice discharge port, and an agitating device for agitating the ice in the ice storage vessel, wherein the operation control device operates the agitating device at the time of ice discharge or ice-making operation and causes, when no ice-making operation is being performed, the agitating device to operate after an interval of a predetermined first set time for a predetermined second set time by timer means, and wherein when the agitating device is stopped by stopping the ice discharge or ice-making operation, the operation control device resets the timer means to start the first set time.

4. An operation control device for an ice dispenser according to claim 3, wherein the timer means comprises a first timer for counting the first set time and a second timer for counting the second set time, and wherein when the agitating device is stopped by stopping the ice discharge or ice-making operation, the operation control device resets the first timer.

5. An operation control method for an ice dispenser, comprising the steps of:

preparing an ice dispenser including an ice-making device, an ice storage vessel, an ice discharge port, and an agitating device for agitating the ice in the ice storage vessel, and an operation control device which operates the agitating device at the time of ice discharge or ice-making operation and which causes, when no ice-making operation is being performed, the agitating device to operate after an interval of a predetermined first set time for a predetermined second set time by timer means, and resetting the timer means to start the first set time when the agitating device is stopped by stopping the ice discharge or ice-making operation.

6. An operation control method according to claim 5, wherein the timer means comprises a first timer for counting the first set time and a second timer for counting the second set time, and wherein the step of resetting the timer means to start the first set time consists in resetting the first timer to start the first set time.

* * * * *